United States Patent [19]

Bernard et al.

[11] Patent Number: 4,785,527

[45] Date of Patent: Nov. 22, 1988

[54] METHOD FOR MANUFACTURING AN INDUCTIVE CHIP

[75] Inventors: Gilles Bernard, Seurre; Jean L. Zatarra, Dijon, both of France

[73] Assignee: Compagnie Europeenne de Composants Electroniques LCC, Courbevoie, France

[21] Appl. No.: 4,397

[22] Filed: Jan. 20, 1987

[30] Foreign Application Priority Data

Jan. 21, 1986 [FR] France ..... 86 00801

[51] Int. Cl.[4] ..... H01F 7/06

[52] U.S. Cl. ..... 29/605; 29/855; 242/7.03; 242/7.09; 264/272.15

[58] Field of Search ..... 29/605, 854–856; 242/7.03, 7.07, 7.09, 7.17, 7.18; 264/272.11, 272.15; 336/65, 96, 192

[56] References Cited

U.S. PATENT DOCUMENTS

| | | | |
|---|---|---|---|
| 4,490,706 | 12/1984 | Satou et al. | 336/96 |
| 4,553,123 | 11/1985 | Tamada et al. | 336/83 |
| 4,662,066 | 5/1987 | Toman et al. | 29/854 |

FOREIGN PATENT DOCUMENTS

| | | | |
|---|---|---|---|
| 56617 | 4/1980 | Japan | 29/605 |
| 28820 | 2/1983 | Japan | 29/605 |
| 127308 | 7/1983 | Japan | 29/605 |
| 224210 | 11/1985 | Japan | 29/602.1 |

OTHER PUBLICATIONS

Patents Abstracts of Japan, vol. 7, No. 292 (E-219) [1437], Dec. 27, 1983; & JP A 58 166 713 (Toukou K.K.) Oct. 1, 1983.

Patents Abstracts of Japan, vol. 8, No. 74 (E-236) [1511], Apr. 6, 1984; & JP A 58 223 306 (Toukou K.K.) Dec. 24, 1983.

*Primary Examiner*—P. W. Echols

*Attorney, Agent, or Firm*—Pollock, VandeSande & Priddy

[57] ABSTRACT

A method for the manufacture of an inductive chip of the type with a wire coiled around a core comprises the following steps:

(a) Fixing the core to a connecting strip made of a metallic material, the strip being provided with slots by which electrical connections can be obtained on either side of the component, (b) Winding a wire around the fixed core, (c) Soldering each end of the wire to each part of the strip designed to form the electrical connections, (d) Coating the wound core, with the connecting strip acting as a mould joint for the moulding process, (e) Cutting out the connecting strip to set off the limits of each component and the parts intended to form the external electrical connections, (f) Folding and fixing the parts delimited in the previous step of the component.

6 Claims, 2 Drawing Sheets

METHOD FOR MANUFACTURING AN INDUCTIVE CHIP

BACKGROUND OF THE INVENTION

1. Field of the Invention

The present invention pertains to a method for the manufacture of an inductive chip, more especially, an inductive chip of the type with a wire coiled around a core.

2. Description of the Prior Art

Chips include different types of inductive components. Thus, in the prior art, there are inductive chips obtained by screen process printing. Inductive chips may be manufactured by a technique of metallizing a pattern on an insulating substrate or on insulating substrates which are stacked on top of one another and provided with a conductive passage which gives electrical continuity among all the layers. These chips are generally inexpensive and well suited to the needs of manufacturers who make equipment for the general public. However, the chips have inductance values ranging from a few nanohenries to some hundreds of microhenries. Furthermore, their Q factor is quite mediocre and they do not tolerate active currents of more than 100 milliamperes.

There are also inductive chips, known in the prior art, made like the conventional self-inducting coil, by winding an insulated wire, generally made of enamelled copper, around a core made of a material which may or may not be magnetic. These chips cover a wide range of inductance values from a few nanohenries to a few millihenries, and their Q-value is often high. However, the methods used to manufacture components of this type have many disadvantages which result, among other factors, from the small dimensions of the core which makes it difficult to wind the wire. Another constraint is related to the soldering of the ends of the coil to the output connections. This soldering is made difficult by the small dimensions of the core, the diameter of the wire and the presence of the enamel which covers it. All the methods currently used for manufacturing coiled inductive chips consist in winding the wire around the core by making the core rotate around a pin and then, once the coil is made, in connecting the ends of the wire to the output connections or electrodes. The method of making the connection have a certain number of disadvantages. There is a considerable risk of unwinding the wire during subsequent handling. Furthermore, for it to be possible to automate the above methods, the cores on which the wires are wound should have the most exact dimensions possible so that the electrodes can be properly positioned and so that the ends of the coil wire can be soldered to these electrodes.

SUMMARY OF THE INVENTION

The purpose of the present invention is to remedy these disadvantages by an inexpensive and entirely automated method to manufacture an inductive chip of the type with a wire coiled around a core.

Consequently, the object of the present invention is to provide a method of manufacturing an inductive chip of the type with a wire coiled around a core, the method comprising the following steps taken together or separately:

(a) Fixing the core to a connecting strip made of a metallic material, the strip having slots by which the output electrical connections can be made on either side of the component, (b) Winding a wire around the fixed core, (c) Soldering each end of the wire to each part of the strip designed to form the electrical connections, (d) Coating the wound core, with the connecting strip acting as a mould joint for the moulding process, (e) Cutting out the connecting strip to set off the limits of each component and the parts intended to form the external electrical connections, (f) Folding and fixing the parts, delimited in the previous step, to the component.

In the method of the present invention, the core is fixed, from the outset, to a connecting strip which will be used throughout the manufacturing cycle, first of all as a support for the core during the winding stage and, then, as a mould joint for the moulding of the coating resin. The core can be fixed to the strip by bonding, clipping on or any other equivalent means. The cutting of slots in the strip makes it possible to set up the electrical connections of the inductive chip, and the imperviousness provided by this strip during moulding averts any risk of fouling the final connections of the component. Furthermore, since the two ends of the wire are soldered to those parts of the strip designed to form the electrical connections immediately after the winding of the wire around the core, there is no longer any risk of unwinding.

For the easier automation of the method, the connection strip will be provided with means for feeding the strip. These means may comprise, for example, holes pierced in the longitudinal edges of the strip and designed to cooperate with teeth of a feeding device.

Furthermore, since the core is fixed at the outset to a strip designed to form the final electrical connections, it is no longer necessary to use a core with a precise and well-dimensioned contour. Consequently, the manufacture of the core itself is simplified.

Moreover, the method of the invention provides numerous advantages as regards the product itself. For, in this case, the electrical connections are moved away from the coil. It is therefore possible to use hotter melting baths for there is greater thermal insulation. Furthermore, the electrical connections are made of solid metal, thus providing excellent solderability. High-performance coating resins can also be used, providing for climatic stability of professional quality.

DESCRIPTION OF THE DRAWINGS

Other characteristics and advantages of the method according to the invention will appear in the following description which is made with reference to the appended figures, of which.

DETAILED DESCRIPTION OF THE PREFERRED EMBODIMENT

Figure 1:
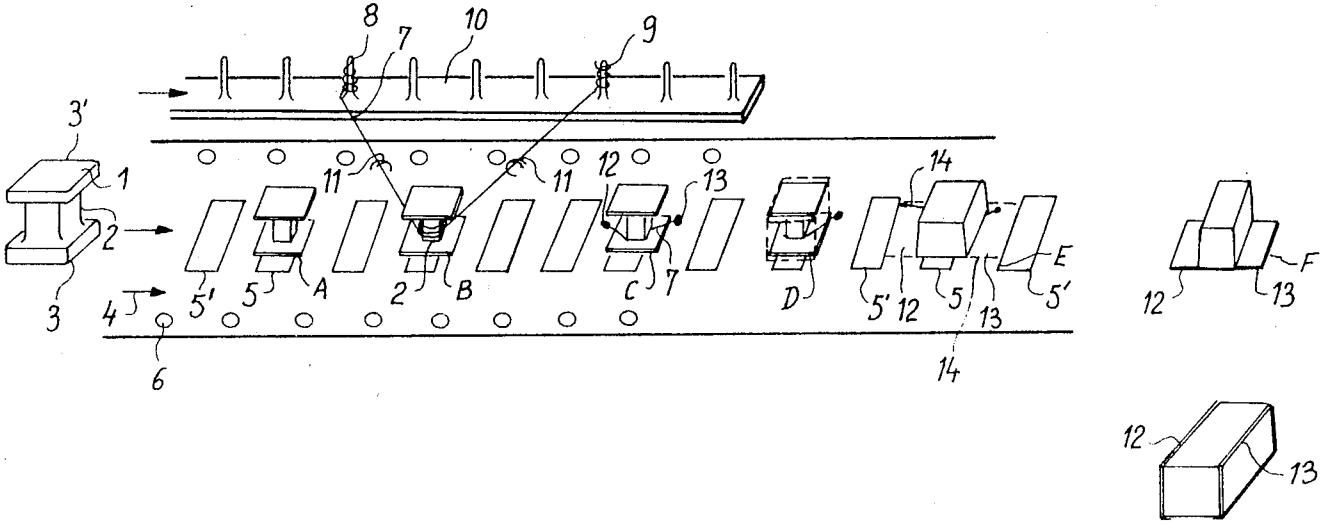
FIG. 1 is a schematic view of the various steps of the method according to the present invention.

As shown on the left-hand part of FIG. 1, the inductive chip obtained by the method of the present invention is prepared from a core made of a material which may or may not be magnetic. This core 1 essentially comprises a cylinder-shaped or parallelepiped-shaped central part 2 and two perpendicular end plates 3 and 3' so as to give a longitudinal section which is substantially shaped like an H. When the core is made of a magnetic material, this material may be made of ferrite, or it may be obtained from powdered plasto-ferrite, ferrite or powdered iron for example. If the core 1 is made of a non-magnetic material, this material may be ceramic or a thermoplastic or thermosetting material. In the method of the present invention, the core 1 does not need to have a very precise shape or dimensions. Coonsequently, the core 1 can be machined directly from a plate of the magnetic or non-magnetic material. The core 1 can thus be made conventionally, by pressing or injection, or by drawing and cutting off, since the shape of the core can be easily extruded.

According to the present invention, the core 1 is first of all brought to a connecting strip 4 which will be used throughout the manufacturing cycle. This first step can be taken, for example, by placing the cores in a bowl feeder or in any other system of distribution which feeds from a store placed above the connecting strip. The connecting strip 4 has slots 5 which will be used to make the output connections or electrodes on either side of the body of the component as will be explained in greater detail below.

As depicted in A in FIG. 1, the cores 1 are laid on certain slots 5 which, in the mode of FIG. 1, are formed as rectangles, the other similar slots 5' being used when the connections are made. Once the cores 1 are positioned on the strip, they are bonded to this strip, using a micro-bonding technique well known to the specialist. According to another mode of operation, the cores can be clipped on to the strip or fixed by any other means. Once the core 1 is bonded to the strip, this strip is carried by the holes 6 (cooperating with a feeding means not shown) to a winding station. According to the present invention, the coil is made by holding the core 1 fixed and winding the wire 7 around the central part 2, using a device of a known type called a "flyer". More specifically, in using the winding device or flyer, the wire 7 is first of all fixed to a pin 8, positioned downstream of the core with respect to the direction in which the machine is moving, this pin being mounted on a follower strip 10 which moves forward at the same time as the connecting strip 4. Then, the wire is wound around the part 2 of the core 1, and is fixed to another pin 9, upstream of the core 1. This is the condition depicted at B in FIG. 1. It is clear to the specialist that, instead of the pins 8 and 9, it is possible to use snugs 11, cut out and folded from the connecting strip 4. This would make it possible to eliminate the follower strip 10.

Once the core has the coil around it, the two ends of the wire 7 are soldered to those parts 12, 13 of the metallic strip which are designed to form the connections. The soldering can be done by any known soldering procedure such as tin-lead soldering with a soldering bit or any appropriate tooling, solder paste, hot-gas jet soldering, electric soldering, induction soldering, laser soldering, cold-pressure soldering with conductive adhesive, etc. This operation is depicted in FIG. 1 at position C.

Once the soldering is done, the conductive strip is brought to a coating station. In this case, the strip 4 is used as the molding joint i.e. the meeting point of top and bottom mold components. The coating can be done according to various known techniques, for example by liquid injection molding with a self-extinguishing resin, powder injection molding, flow molding, etc. A type of resin that can be used is a resin that gives the component efficient heat protection during wave soldering. The resin may also be non-charged, with a low heat conductivity, charged or alveolate in the form of foam. Furthermore, a magnetic charge may be incorporated into this resin to close the magnetic circuit and thus enhance the magnetic quality of the component.

After withdrawal from the mould, the inductive chip has the shape depicted at D, in FIG. 1. The chip is then sent to a cutting-out and raising station where the electrodes are made. To do this, as depicted at E in FIG. 1, the connecting strip is cut out along the lines of dashes 14. In the embodiment of FIG. 1, these lines of dashes are planned between the slots 5–5' of the connecting strip 4. Thus, the component depicted in F in FIG. 1 is obtained. The parts 12, 13 of the strip, on either side of the chip, are then folded back against the two side edges to form the electrodes. Preferably, the upper part is raised and folds down on the component so that the electrodes are well fixed. However, as explained above, it is clear to the specialist that other shapes of slots can be envisaged for the electrodes so that the electrodes are well fixed to the sealed-in body of the component. Furthermore, the fold is done so that there is a minimum of connection entering into the magnetic circuit, thus providing maximum Q-value.

Figure 2:
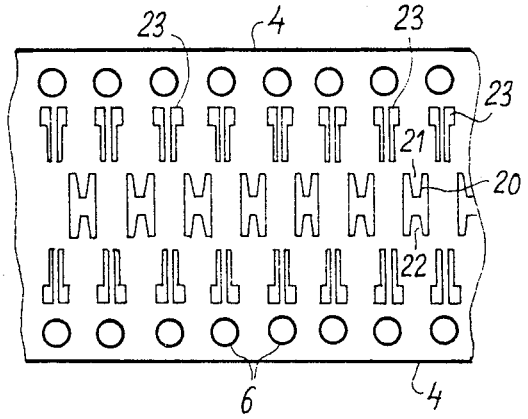
FIG. 2 is a top view of another mode of embodiment of the connection strip used in the method of the present invention.
Figure 3:
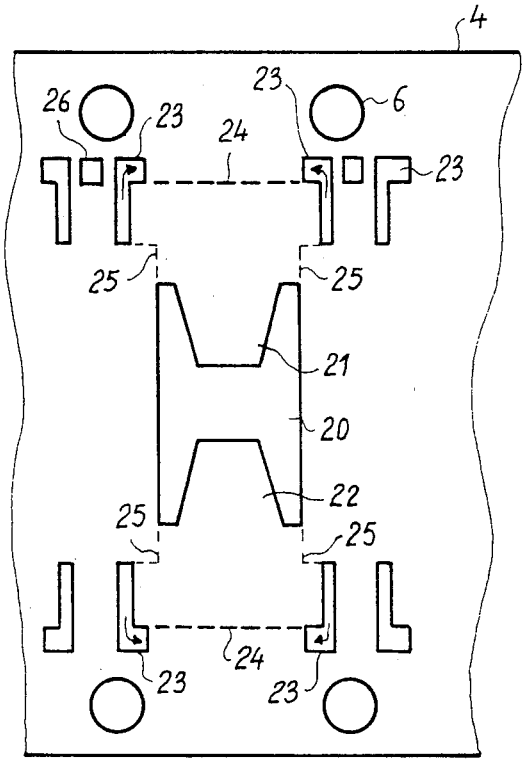
FIG. 3 is an enlarged view of a part of the connecting strip of FIG. 2.

With reference to FIGS. 2 and 3, we shall now describe a particular embodiment of the connecting strip 4, used in the method of the present invention. This connecting strip is of the same type as the connecting strip described in the French patent application No. 85 07148 filed on May 10, 1985 on behalf of the applicant and used, more especially, for the manufacture of chip capacitors.

The strip 4 therefore comprises a flexible metallic sheet and a material of low heat conductivity such as steel, bronze, etc. On this connecting strip 4, several types of slots are planned in order to facilitate making the output connections or electrodes of the inductive chip. Hence, it is necessary that those parts of the strips which form the connections or electrodes are not in short-circuit. Consequently, the strip 4 has H-shaped slots 20 made so that there are two metallic tongues 21 and 22 which will act as lugs to fasten the parts that constitute connections or electrodes to one of the end plates of the coil core. It is preferable for the slot to be made so that the tongues 21 and 22 are attached to the rest of the sheet along flare-shaped surfaces, as is clearly shown in FIG. 3. This will make it easier to fold the tongues, and will give greater elasticity to the fastening lugs to hold the core 1. Other slots made in the strip 4 will determine the shape of the electrodes of the future chips. These are L-shaped slots as depicted in FIG. 2, with the reference 23.

Each H-shaped slot 20 has four corresponding L-shaped slots 23 which frame it. Moreover, each side edge of the strip is pierced with holes 6 which will be used for its feeding by means of an appropriate device within the scope of the automated manufacturing of the inductive chip.

With the strip described above, the cutting out of the electrodes will be done as depicted by the dashes 25 and 24 in FIG. 3. The dashes 25 join each L-shaped slot 23 to the slot 20, and the dashes 24 join the L-shaped slots 23 to each other. Furthermore, as depicted in FIG. 3, the strip is preferably provided with snugs 26 made by cutting out and folding a part of the strip itself. The snugs 26 are positioned, for example, between each pair of L-shaped slots 23, and are used, during the winding process, to fix the coil wire before soldering.

It is clear to the specialist that the connecting strip of FIG. 1 or the connecting strip of FIGS. 2 and 3 have been given by way of example, especially as regards the shape of the slots. Consequently, this strip may be provided with slots of different shapes, provided that the said slots can be used to make the electrodes or connections of a coil-type inductive chip.

Moreover, the method has been described with reference to a coil-type inductive chip. It is clear to the specialist that this method can be used to make other components which require, more particularly, the winding of a wire around a core.

What is claimed is:

1. A method for the manufacturing of a component comprising an inductive chip of the type with a wire wound around a core, the method comprising the following steps:

(a) fixing the core to a connecting strip made of a metallic material, said strip being provided with slots by which electrical connections can be obtained on either side of the component, (b) winding a wire around the fixed core, (c) soldering each end of the wire parts of the strip designed to form the electrical connections, (d) coating the wound core in a molding step, with the connecting strip acting as a mold joint for the molding step, (e) cutting the connecting strip to define limits of each component including parts of the connecting strip intended to form external electrical connections for the chip, (f) folding the parts to form the connections defined in the previous step and fixing the parts to the component.

2. A method according to claim 1, wherein the core is fixed to the strip by bonding or clipping on.

3. A method according to claim 1, wherein the coil is made by fixing one end of the wire to first fixing means adjacent the core, by winding the wire around the core and by fixing the other end of the wire to second fixing means also adjacent the core.

4. A method according to claim 3, wherein the ends of the wire are fixed to snugs.

5. A method according to claim 3, wherein the ends of the wire are fixed to pins mounted on a support which follows the connecting strip.

6. A method according to claim 1, wherein the bonding, winding, soldering, coating and cutting-out operations are performed continuously, the connecting strip being designed to receive at least one core and being provided with means for feeding the connecting strip.

* * * * *